United States Patent [19]

Saul

[11] 4,071,064

[45] Jan. 31, 1978

[54] PACKING CONTAINER OR RECEPTACLE

[76] Inventor: Franz J. Saul, Guerzenicher Strasse 61, 5160 Dueren, Germany

[21] Appl. No.: 685,905

[22] Filed: May 12, 1976

[30] Foreign Application Priority Data

May 13, 1975 Germany ..... 2521252
Nov. 5, 1975 Germany ..... 2549604

[51] Int. Cl.[2] ..... B65D 11/20; B65D 37/00

[52] U.S. Cl. ..... 150/48; 229/23 BT; 229/43

[58] Field of Search ..... 150/48, 50; 229/23 BT, 229/43, 14; 206/45.34, 45.19, 45.14

[56] References Cited

U.S. PATENT DOCUMENTS

| | | | |
|---|---|---|---|
| 1,176,755 | 3/1916 | Heinrich | 150/48 UX |
| 1,251,404 | 12/1917 | Mills | 150/48 UX |
| 2,935,108 | 5/1960 | Hall | 150/48 |
| 3,034,552 | 5/1962 | Herz | 150/52 R |
| 3,172,444 | 3/1965 | Frommelt et al. | 150/50 |
| 3,670,881 | 6/1972 | Dutcher | 206/45.34 |

*Primary Examiner*—Davis T. Moorhead
*Attorney, Agent, or Firm*—William G. Rhines

[57] ABSTRACT

The present invention provides a packing container or receptacle comprising a shell body made of paper, cardboard, fabric, plastic or metal films and the like and having, for example, a circular or rectangular or otherwise polygonal cross-section, with the cover and/or bottom parts of said shell body including an axially extending side wall across the axial depth of which said cover is adapted to be inserted, at least partially, into an open end of said shell body, whereby the side wall of said container cover or of said bottom part, respectively, and the edge of said container or receptacle are secured against unintentional opening by means of fastener elements, wherein the improvement comprises that said fastener elements include at least one narrow clip flap being mounted to the upper edge of said container cover or of said bottom part, respectively, and being adapted to be flexibly folded from the outer side around the edge of said container or receptacle and which clip flap carries a stiff, pin-like lug on its side abutting the outer face of said container or receptacle, which lug passes through aligned apertures provided in the shell body adjacent the edge of the container or receptacle and in the side wall of said cover or said bottom part, respectively, said lug being mounted to the side wall of said cover or bottom part so as to be adapted to be repeatedly closed and released.

10 Claims, 9 Drawing Figures

10
5
4b
4a
4
5
6
2
6
6
6
8
1

5
5a
3d
7
9
5a
3
5

7
5a
5
5c
3b

2
B
5
6
7
3b
D
5a
C
3a 3b
2
5a
5
6
F
7
E
G
H
3a
5c

PACKING CONTAINER OR RECEPTACLE

BACKGROUND OF THE INVENTION

The present invention relates to a packing container or receptacle comprising a shell body made of paper, cardboard, fabric, plastic or metal films and the like and having, for example, a circular or rectangular or otherwise polygonal cross-section, with the cover and/or bottom parts of said shell body including an axially extending side wall across the axial depth of which said cover is adapted to be inserted, at least partially, into an open end of said shell body, whereby the side wall of said container cover or of said bottom part, respectively, and the edge of said container or receptacle are secured against unintentional opening by means of fastener elements.

It is well known to secure receptacle covers or bottom parts of a packing container against unintentional opening in such way that the cover or the bottom part is recessedly inserted into the container opening and provided with a collar extending continuously around the edge of the container. This continuous collar encircles the container edge from the other side thereof, and it is securely connected to the edge surface or side wall of the receptacle cover inserted into the container opening, through apertures provided in the encircled edge of the container or receptacle.

However, constructions of the cover closure means of this type, on the one hand, require great expenditure of work and material because of the continuously extending collar. On the other hand, the attachment of the continuous collar to the side wall is not suitable for repeated use; more particularly, as soon as the attachment has been broken up by the initial removal of the receptacle cover which, besides, is rather difficult, the cover can be placed again onto the container or receptacle without any additional mounting only.

SUMMARY OF THE INVENTION

Therefore, it is the object of the present invention to provide packing means which allow to avoid the drawbacks of the conventional structures.

Surprisingly, this object is solved in accordance with the invention by a packing container or receptacle of the above-indicated type wherein said fastener elements include at least one narrow clip flap being mounted to the upper edge of said container cover or of said bottom part, respectively, and being adapted to be flexibly folded from the outer side around the edge of said container or receptacle and which clip flap carries a stiff, pin-like lug on its side abutting the outer face of said container or receptacle, which lug passes through aligned apertures provided in the shell body adjacent the edge of the container or receptacle and in the side wall of said cover or said bottom part, respectively, said lug being mounted to the side wall of said cover or bottom part so as to be adapted to be repeatedly closed and released.

If the pin-like lug includes in the portion where it passes through the side wall, a latch element adapted to be disengaged by tensional load acting in the longitudinal direction of the lug, and which extends at least at the side of the periphery of the lug opposite the container edge, then such latch element need provide a relatively slight latching action only without thereby impairing the safeness of closure. That is, as soon as a tensional load is experted between the shell body and the cover or the bottom part of the receptacle by the contents thereof, the pin-like lug is urged from the shell body against the respective lateral side of the aperture in the side wall of the cover such that the safety closure effect is increased. On the other hand, the pin-like lug may be withdrawn with little effort by swinging the clip flap upwards.

Although the packing container or receptacle according to the invention may have an only thin-walled and optionally foldable or flexible shell body, this shell body forms a structurally stable packing container in combination with the receptacle covers (cover and bottom portion) which are inserted into the end faces in recessed fashion and possibly with a press fit, whereby in spite of the flexible clip flap the stiff side wall of the receptacle cover of the bottom part provides a stable and stiff abutment for the pin-like lug, which abutment, owing to its strength, may be repeatedly subjected to stress for opening and re-closing without impairing the safeness of the closure. In particular, the combination of the flexible clip flap and of the stiff configuration of the pin-like lug is also important for the functioning of the safety clip-type closure means according to the invention because the lug does not yield in its state as inserted into the apertures, while the flexibility of the clip flap in the loaded condition provides for secure retaining in the side wall and facilitates the passage through the apertures during the opening operation. The flexibility of the clip flap and the stiffness of the lug may be obtained solely by different thicknesses of material of the components which in general are formed integrally with the remainder of the cover or bottom part, respectively, from plastic material by mass production techniques.

Furthermore, the safety clip-type closure means according to the invention may be combined with a handle or carrying means by attaching a thin string between the clip flap and the shell body to the pin-like lug, or by placing a loop around the lug, respectively, such that the packing container may be carried as suspended from such string. If the carrying string is in the manner attached to a pair of opposite clip flaps on the cover, the weight of the container results in an increased mounting effect of the lug.

In detail, the pin-like lug may have along its full length such a thickness which corresponds approximately to the diameter of the aperture in the side wall or slightly less.

Moreover, alternatively the pin-like lug may be provided with a notch which in the engaged or snapped-in state is positioned approximately at the inner edge of the aperture provided in the side wall.

A particular embodiment of the clip flap comprises that said clip flap includes, with a slight spacing from the position of its mounting to the upper edge of said container cover or bottom part, a readily bendable weakening line extending along at least part of the line of mounting.

Hereby, the weakening line may be formed by a groove provided on the inner face of the clip flap, which groove may be provided also in the outer face of the clip flap, however.

In a particularly simplified embodiment of the safety clip-type closure means, the aperture in the side wall of the receptacle cover or of the bottom part, respectively, may be closely spaced from the underside of the wall surface of the cover or bottom part, respectively, and the pin-like lug of the clip flap may abut the wall surface with its free end in the closed position.

Preferably, the clip-type closure means may be arranged in pairs on the cover or bottom part, respectively, opposite to each other. Furthermore, both packing containers of a circular or elliptical cross-section and such of a polygonal cross-section may be provided with the clip flaps according to the invention.

In this way, the use of the clip flaps provides a particularly advantageous multiple function. Apart from the simplified handling and the expedient manufacture as mass production article, the clip flaps on the one hand serve as retainer elements for the pin-like lugs, and on the other hand — upon disengagement of the lugs — as a grip handle for withdrawing the cover or bottom part, respectively, from the shell body of the packing container.

This multiple function also includes the safety function for the safety mounting means which may be opened repeatedly and without destructions, as well as the possibility of attaching the loop of carrying means, whereby the receptable cover or the bottom part, respectively, is prevented from unintentional slipping out from the shell body.

In order to prevent the cover or the bottom part from slipping into the interior of the shell body, the outer edge of each of these elements may be provided with a stop or abutment shoulder which at the same time serves as reinforcing means and for the mounting of the clip flaps. Further, if a plurality of clip flaps are provided, this abutment action may be provided by the clip flaps per se.

The packing container according to the invention may be used particularly also for heavy contents, such as flowers in vases or bottles, which in the above-described structure composed of the shell body provided with cover and bottom part could hertofore not adequately secured against unintentional detachment of these components. Primarily in decorative packings of this kind it may be of importance that particularly the bottom part is detached from the remainder of the packing container such that this bottom part may be used as a base for the contents of the packing, e.g. a vase for flowers.

In order to make sure that the marginal portion of the shell body is sufficiently stable to take up the tensional loads, cover and bottom parts may be formed so as to be adapted to be fitted into the shell body in a correspondingly deep position.

The wall surface of the cover or bottom portion may be disposed either at the recessedly inserted edge of the side wall or even at the portion of the side wall adjacent the edge of the container, such that in the latter embodiment only the side wall is recessedly inserted into the shell body.

DESCRIPTION OF DRAWINGS

The invention is explained below in several embodiments by making reference to the accompanying drawings, wherein.

DESCRIPTION OF PREFERRED EMBODIMENTS

Figure 1:
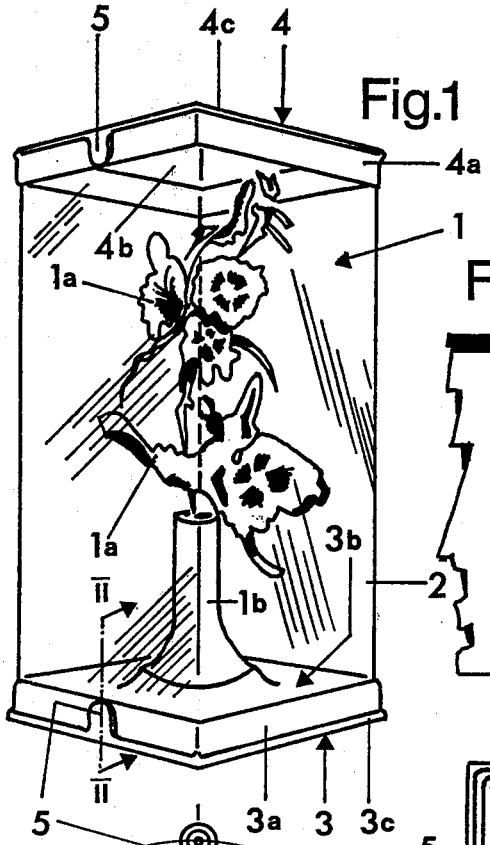
FIG. 1 is a perspective view of a packing container according to the present invention and comprising a shell body of transparent plastic material through which the container contents, i.e. a flower arrangement with a vase, is visible.

As shown in FIG. 1, the packing container 1 comprises a central shell body 2 which may be formed of a transparent plastic material, e.g. from PVC, as well as a bottom part 3 and a cover portion or container cover 4 each, which items in turn each have side walls 3*a* and 4*a*, respectively, by means of which these components are inserted, optionally with a press fit, into the end openings (open ends) of the shell body 2 in recessed fashion.

Interiorly of the packing container or receptacle 1, a flower arrangement 1*a* is disposed in a vase 1*b* which is retained to the wall 3*b* of the bottom portion 3 by positive or frictional engagement 3*d* or, alternatively, by means of vacuum connection.

Upon opening of the container, the vase 1*b* may be placed in the desired location either detached from the bottom part 3 or in the state as secured to the latter.

Figure 3:
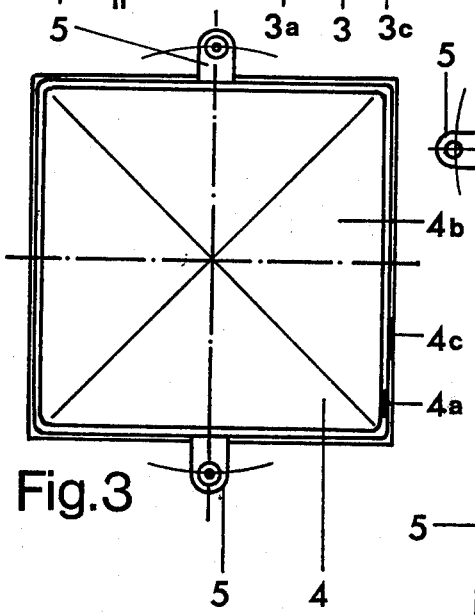
FIG. 3 is a plan view of a cover portion showing the outwardly spread position of the clip flaps corresponding approximately to the state as formed during mass production.
Figure 4:
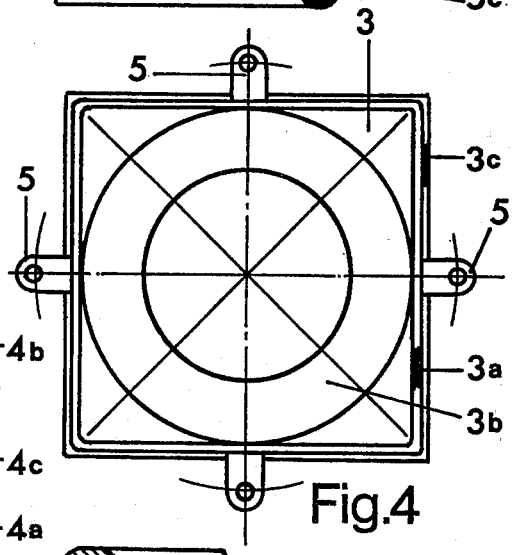
FIG. 4 is a plan view similar to FIG. 3 of a bottom part having four clip flaps.

Cover and bottom parts each have a pair of clip flaps 5 attached laterally thereof at the free edge of side walls 3*a* or 4*a*, respectively, and that advantageously in the form of diametrically opposite pairs of flaps. Different from FIGS. 1 and 3, FIG. 4 shows a modified bottom portion 3 with a structure reinforced by four clip flaps 5.

Figure 2:
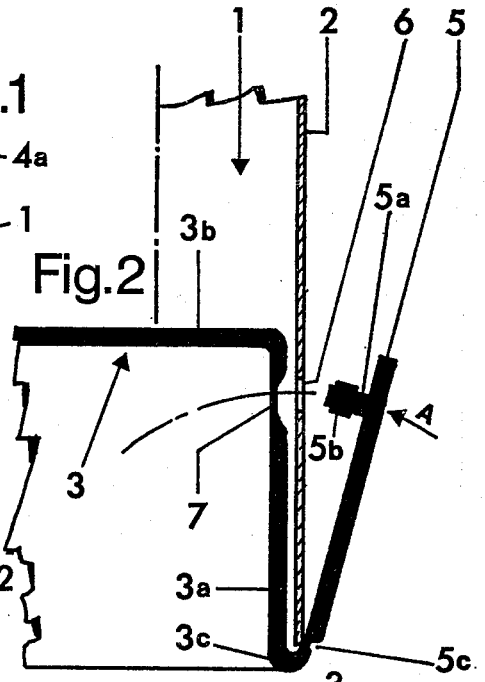
FIG. 2 is a greatly enlarged part sectional view along lines II — II in FIG. 1.

FIG. 2 illustrates a clip flap 5 during the closing movement as indicated by arrow A, wherein the clip flap 5 which carries a pin-like lug 5*a* on its side opposing the side wall, is pressed with its lug 5*a* through an aperture 6 in the shell body 2 and an aperture 7 in side wall 3*a* until the latch element 5*b* snaps in at the inner side of side wall 3*a*. For manufacturing purposes, the aperture 7 may be formed also as a weakened portion in side wall 3*a*. As shown in FIG. 2, the latch element 5*b* comprises a slight enlargement (thickened portion) of lug 5*a*.

As shown in FIG. 2, bottom part 3 is inserted into the end opening of the shell body 2 with its full axial depth, i.e. the height of side wall 3*a*, such that the edge of the shell body 2 abuts a marginal shoulder 3*c* extending continuously around the outer edge of side wall 3*a*. Each clip flap 5 is integrally mounted to such marginal shoulder 3*c*. When cover and bottom parts 4 and 2, respectively, are made of polypropylene, the clip flap is adapted to be swung around a weakening line 5*c* which is defined by a groove (FIG. 2) provided on the outer face. In the case of the harder polystyrene, such groove is provided in the side of the clip flap 5 opposing the shell body 2 (FIG. 7).

Clip flaps 5 for cover and bottom parts 3 or 4, respectively, are of identical configuration, whereby the clip flap 5 per se is formed with a relatively thin wall thickness so as to be readily bendable, whereas the lug 5*a* of such flap is relatively stiff because of its thickner material.

Figure 5:
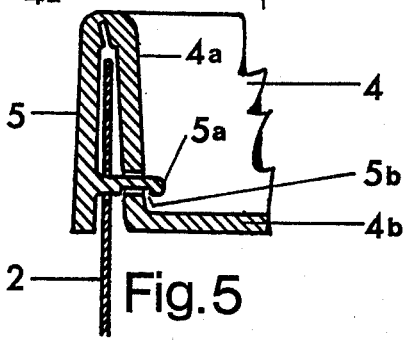
FIG. 5 is a part sectional view slightly enlarged as compared to FIG. 2 and showing the clip device engaged in its secured position on the container cover, with a modified structure of the lug, namely with a notch serving as the latch element.

According to FIG. 5, the lug 5*a* is provided with a small notch serving as the latch element, which notch is effective only at the peripheral portion of the aperture adjacent the wall surface 4*b* of cover portion 4.

Figures 6, 7, 8, 9:
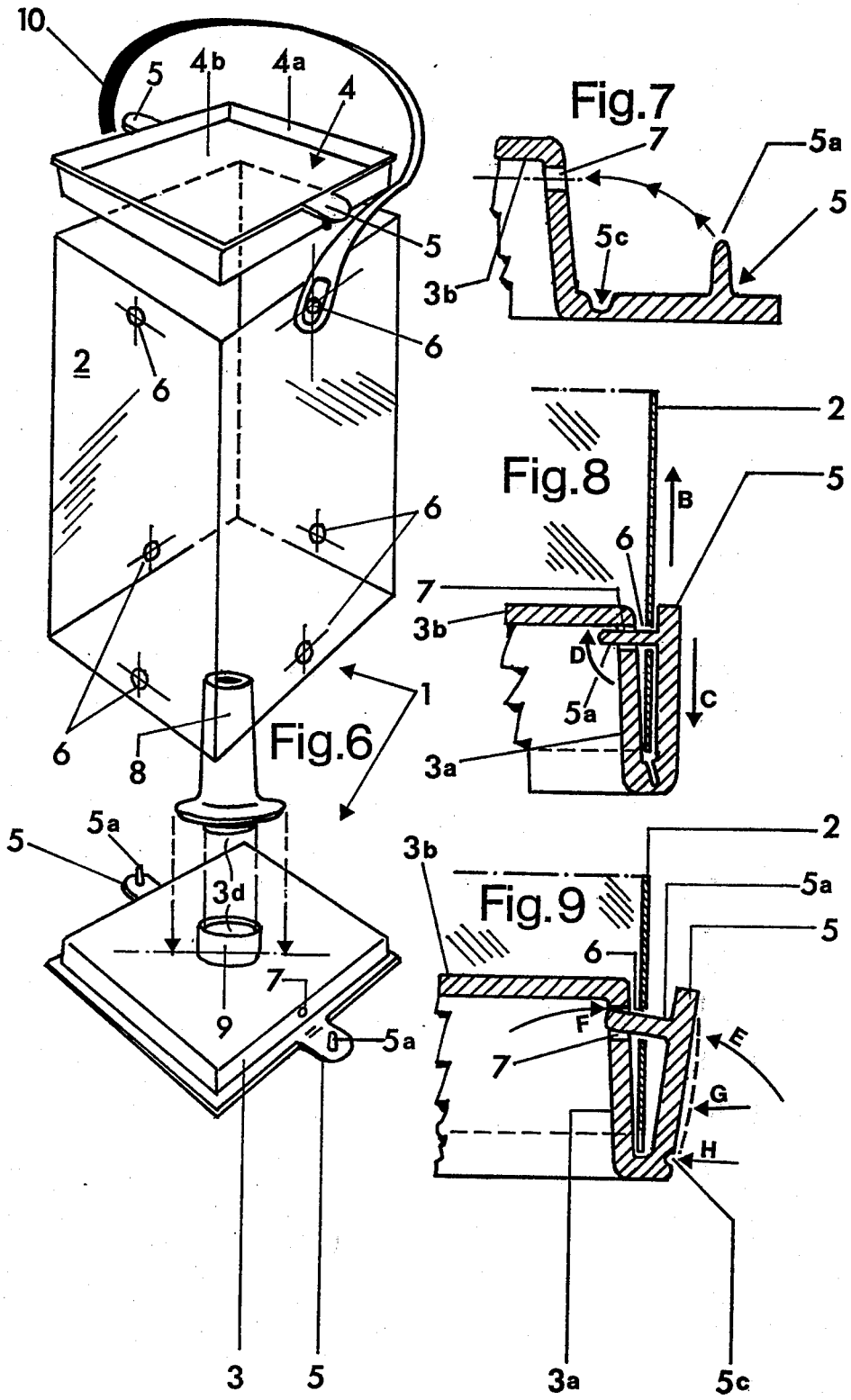
FIG. 6 is a perspective exploded view of the packing container and showing a flower-vase to be attached to the bottom part.
FIG. 7 is a sectional view of another embodiment of the safety clip-type closure means in the opened position corresponding approximately to the state as obtained in mass production.
FIG. 8 shows the safety clip-type closure-means according to FIG. 7, but in its closed position.
FIG. 9 shows a safety clip-type closure means according to FIG. 8 in an intermediate position during manipulation thereof.

In the embodiment shown in FIG. 6, a vase structure 8 may be releasably attached to the bottom part 3 by means of a frictional engagement device 9. The clip flaps 5 show a further modified configuration of the pin-like lug 5*a* which, as shown in FIGS. 7 and 8, is formed as a straight (uncontoured) lug having an approximately constant diameter. The aperture 7 provided in side wall 3*a* — particularly in the modified embodiment according to FIG. 8 — is positioned with a very close spacing under the wall surface 3*b* or 4*b* of the bottom part such that lug 5*a* in its closed position according to FIG. 8 rests against the wall surface, as shown by arrow D, under tensional load applied between the shell or peripheral face and the bottom part according to arrows B and C, thereby increasingly securing the attachment of the bottom part or of the cover portion, respectively, with increasing load.

Finally, FIG. 6 illustrates the provision of carrying or handle means in the form of a carrying loop 10.

As separately shown in FIG. 9, the free end of the pin-like lug 5*a* upon closing of the clip flap 5 (in the direction of arrow E) abuts against the edge of aperture 7 at a point F, because of the different radii. Owing to the slightly curved configuration of the free end of the pin-like lug, this lug in the further closing movement whereby a corresponding, slight resistance has to be overcome, fully engages into aperture 7, namely particularly behind the edge portion of said aperture which was first engaged by the lug as shown by arrow F. During the snap-in or engagement action, the deflection of lug 5*a* at the edge of aperture 7 either cause a material accumulation (arrow H) to take place at the weakening line 5*c*, and/or the clip flap 5 becomes slightly bent outwards in its portion G. Both functions the forces or magnitudes of which may be easily varied as desired in combination by controlling the material thicknesses of clip flap 5, lug 5*a* and weakening line 5*c*, provide the effect that the lug 5*a* cannot become disengaged unintentionally by itself because during the opening operation the same forces result as during the closing operation, as described above. Then, the free end of lug 5*a* — as shown — may be slightly curved or provided with a corresponding bevelling. Opening may be facilitated by applying, by the finger nail, oppositely acting pressure from the interior of the bottom or cover portion, if the closure action of the safety clip-type closure means is set to higher opening forces.

What I claim is:

1. A container closure means comprising a planar wall with an aperture therein for juxtapositioning to the edge region of a wall of a container, a clip flap that is integral with the edge of said planar wall and is pivotally moveable with respect thereto at a bendline, an elongated lug, which 1. has one end integral with, and is substantially perpendicular to, the surface of said clip flap which, when said clip flap is in the unpivoted position with respect to said planar wall, faces in the same direction as does the surface of said planar wall to be juxtaposed to said container wall, and
2. is substantially the same distance from said bendline as is said aperture, and retaining means for causing said lug to resist withdrawal from said aperture when said lug has been inserted therein.

2. The device described in claim 1 wherein said retaining means comprises 1. said lug being so positioned on said clip flap and with respect to said aperture that at least a portion of the side of said lug facing away from said hingeline will bear with force on the peripheral wall of said aperture when said lug is positioned therein by virtue of said clip flap having been moved pivotally at said hingeline, and
2. said lug being stiff against lateral deflection, and
3. selected portions of said clip flap being preferentially weakened to cause said clip flap to bow outward between said hingeline and said lug by the torque force moment exerted on the free end of said clip flap by virtue of said lug bearing with force on said peripheral wall of said lug.

3. The device described in claim 1 wherein said lug includes a latch element on at least one side of the periphery of the outermost end of said lug.

4. The device described in claim 2 wherein said lug includes a latch element on at least one side of the periphery of the outermost end of said lug.

5. The device described in claim 3 wherein said latch includes a notch in the side thereof which faces away from said bendline.

6. The device described in claim 4 wherein said latch includes a notch in the side thereof which faces away from said bendline.

7. The device described in claim 1 wherein the edge of said sidewall to which said clip flap is hinged is adjacent a portion of said sidewall which curves outward therefrom to form a marginal shoulder for receiving the end of a peripheral wall of a container.

8. The device described in claim 2 wherein the edge of said sidewall to which said clip flap is hinged is adjacent a portion of said sidewall which curves outward therefrom to form a marginal shoulder for receiving the end of a peripheral wall of a container.

9. The device described in claim 3 wherein the edge of said sidewall to which said clip flap is hinged is adjacent a portion of said sidewall which curves outward therefrom to form a marginal shoulder for receiving the end of a peripheral wall of a container.

10. The device described in claim 4 wherein the edge of said sidewall to which said clip flap is hinged is adjacent a portion of said sidewall which curves outward therefrom to form a marginal shoulder for receiving the end of a peripheral wall of a container.

* * * * *